US009877896B2

(12) United States Patent
Mitani

(10) Patent No.: US 9,877,896 B2
(45) Date of Patent: Jan. 30, 2018

(54) MEDICINE CASSETTE

(71) Applicant: YUYAMA MFG. CO., LTD., Toyonaka-shi, Osaka (JP)

(72) Inventor: Mitsuhiro Mitani, Toyonaka (JP)

(73) Assignee: YUYAMA MFG. CO., LTD., Toyonaka-shi (JP)

( * ) Notice: Subject to any disclaimer, the term of this patent is extended or adjusted under 35 U.S.C. 154(b) by 0 days.

(21) Appl. No.: 15/328,431

(22) PCT Filed: Jul. 21, 2015

(86) PCT No.: PCT/JP2015/070750
§ 371 (c)(1),
(2) Date: Jan. 23, 2017

(87) PCT Pub. No.: WO2016/013553
PCT Pub. Date: Jan. 28, 2016

(65) Prior Publication Data

US 2017/0216150 A1 Aug. 3, 2017

(30) Foreign Application Priority Data

Jul. 23, 2014 (JP) ..... 2014-150196

(51) Int. Cl.
*B65D 83/04* (2006.01)
*A61J 7/00* (2006.01)

(52) U.S. Cl.
CPC ..... *A61J 7/0076* (2013.01); *B65D 83/0409* (2013.01)

(58) Field of Classification Search
CPC ..... B65B 35/06; B65B 35/26; B65G 47/14; B65G 47/1457; A61J 7/0076; B65D 83/0083; G07F 11/32; G07F 17/0092
(Continued)

(56) References Cited

U.S. PATENT DOCUMENTS 8,827,112 B2 * 9/2014 Yuyama ..... A61J 7/02 221/224
9,242,785 B2 * 1/2016 Yuyama ..... B65B 35/06
2016/0251094 A1 * 9/2016 Takahama ..... B65B 35/08 53/495

FOREIGN PATENT DOCUMENTS

JP 3-147616 A 6/1991
JP 2000-203525 A 7/2000
(Continued)

OTHER PUBLICATIONS

WIPO, Japanese International Search Authority, International Search Report and Written Opinion dated Aug. 25, 2015 in International Patent Application No. PCT/JP2015/070750, 9 pages.

*Primary Examiner* — Timothy R Waggoner
*Assistant Examiner* — Ayodeji T Ojofeitimi
(74) *Attorney, Agent, or Firm* — Masuvalley & Partners

(57) ABSTRACT

[Object] To achieve a compact construction while making it possible to dispense a medicine certainly one by one.
[Solution] A medicine dispensing unit for dispensing a medicine retained is disposed. The medicine dispensing unit comprises a first rotator having a circular face rotatably disposed at a slant state to a horizontal plane; a second rotator having a ring face rotatably disposed over the horizontal plane at an outer peripheral side of the first rotator; and a guide member having a guide face, the guide face being disposed above the circular face of the first rotator while extending radially with respect to the circular face, being positioned at a downstream side in a rotational direction of the first rotator towards a periphery in a radial direction, and being capable of contacting with the medicine placed on the first rotator due to rotation of the first rotator.

2 Claims, 7 Drawing Sheets

(58) Field of Classification Search
USPC ..... 221/237, 224, 236
See application file for complete search history.

(56) References Cited

FOREIGN PATENT DOCUMENTS

| | | | |
|---|---|---|---|
| JP | 2002-347921 | A | 12/2002 |
| JP | 2008-127133 | A | 6/2008 |
| JP | 3148073 | U | 1/2009 |
| WO | WO2013/035692 | A1 | 3/2013 |

* cited by examiner

MEDICINE CASSETTE

RELATED APPLICATIONS

This application is the U.S. National Phase of and claims priority to International Patent Application No. PCT/JP2015/070750, International Filing Date Jul. 21, 2015, entitled Medicine Cassette; which claims benefit of Japanese Patent Application No. JP2014-150196 filed Jul. 23, 2014 entitled Medicine Cassette; both of which are incorporated herein by reference in their entireties.

TECHNICAL FIELD

The present invention relates to a medicine cassette.

BACKGROUND ART

Conventionally, as an apparatus for supplying small articles (goods) in an aligned form, it has been known that the one which comprises, for example, a first circular rotator rotated by a first driver means and a second ring shaped rotator rotated by a second driver means (e.g. for example, see Patent Literature 1).

Besides, as an apparatus for dispensing tablets, it has been known that the one in which a first rotator is rotated at a high speed to move the tablets to an outer peripheral side by a centrifugal force and subsequently a second rotator of a low speed disposed at the outer peripheral side dispenses them to the outside (e.g. for example, Patent Literature 2).

Now, there are earnest needs for a miniaturization of a medicine packaging apparatus in relation to an installation space and there are increasing needs to miniaturize a medicine cassette. Thus, when the foregoing construction is adopted, a size of an outer diameter of the first rotator becomes small and hence, a higher speed rotation may be required so as to exert sufficient centrifugal force to the tablets etc. by a rotation thereof. As the result, the tablets etc. will be moved to a circumference direction in high speeds such that there are possibilities for dispensing the tablets erroneously beyond necessities. In addition, since the first rotator is rotated in high speeds, risks for damaging the tablets may be increased. On the other hand, when the rotation speeds may not be brought high, the dispensing may be impossible due to insufficient centrifugal force exerted to the tablets.

PRIOR ART LITERATURE

Patent Literature

Patent Literature 1: Japan Koukoku (examined patent publication) No. 1-51403

Patent Literature 2: International Patent Publication No. 2013/118838

SUMMARY OF INVENTION

Technical Problem

An object of the present invention is to provide a medicine cassette which may have a compact construction while not giving damages to tablets and also ensuring to dispense the tablets certainly one by one.

Solution to Problem

The present invention, as a means for solving a problem, may provide a medicine cassette comprising a medicine dispensing unit for dispensing a medicine retained, the medicine dispensing unit may comprise a first rotator having a circular face rotatably disposed at a slant state to a horizontal plane; a second rotator having a ring face rotatably disposed over the horizontal plane at an outer peripheral side of the first rotator; and a guide member having a guide face, the guide face being disposed above the circular face of the first rotator while extending radially with respect to the circular face, being positioned at a downstream side in a rotational direction of the first rotator towards a periphery in a radial direction, and being capable of contacting to the medicine placed on the first rotator due to rotation of the first rotator.

By the above feature, when the first rotator is rotated, the medicine moves toward a circumference direction according to the rotation thereof to contact with the guide face of the guide member and then moves to a radially outer side along the guide face. Therefore, even though the first rotator is not rotated at high speeds, the medicine may be moved smoothly to the radially outer side by the guide member.

It may be preferred in the guide member that at least a part including the guide face to be contacted to the medicine is capable of deforming elastically so as to modify a positional relationship to the second rotator depending on a size of the medicine.

It may be preferred that the first rotator is rotated at a rate at which the medicine is not allowed to move to an outer peripheral side only by a centrifugal force, but is allowed to move to the outer peripheral side along the guide member.

By the above feature, movement speeds of the medicines by the first rotator toward the peripheral direction are prevented from increasing so much and it may be possible to prevent dispensing amounts from becoming immeasurable.

It may be preferable that the first rotator and the second rotator are rotated by an identical driver means.

By the above feature, the construction may be simplified and a compact one. This may be arisen from the fact that there is no need for increasing a rotation speed of the first rotator by disposing the guide member of the above feature. Besides, since a rotation speed of the second rotator may be suppressed so that dispensing accuracy for dispensing certainly the medicine one by one may be improved.

It may be preferable that the first rotator and the second rotator are stopped every time one medicine is dispensed.

By the above feature, the medicine may be dispensed certainly one by one. Particularly, this feature may be effective when the first rotator and the second rotator are rotated by an identical driver means.

It may be preferred that a medicine supplying unit for supplying the medicine to the medicine dispensing unit is disposed and that the medicine supplying unit is capable of supplying the medicine depending on replenishment status of the medicine at the medicine dispensing unit.

By the above feature, amounts of medicines at the medicine dispensing unit may be always controlled to values suitable for dispensing action.

It may be preferred that the medicine supplying unit is detachable from the medicine dispensing unit and comprises a supply port for supplying the medicine to the medicine dispensing unit and a shutter member for closing the supply port when the medicine dispensing unit is detached from the medicine supplying unit.

By the above feature, when supply of the medicines is necessary, easy addressing may be possible by removing the medicine supplying unit. The supply port may be closed by the shutter member so that falling down of the medicines may be protected as for safe handling when the medicines stay in the medicine supplying unit.

It may be preferred that the medicine cassette is attachable to and detachable from a cassette attaching part, and the shutter member closes the supply port of the medicine dispensing unit when the medicine cassette is detached from the cassette attaching part.

By the above feature, when there are necessities for supplying the medicines, the medicine cassette may be detached from the cassette attaching part and since the supply port is closed by the shutter member so that there may be no care about spilling out of the medicines even though the medicines remain in the medicine supply unit.

Advantageous Effect of Invention

According to the present invention since the guide member is provided, the medicines may be moved smoothly to the second rotator if a rotation speed of the first rotator is not fast. Thus, the medicines may be dispensed certainly one by one. Besides, when a compact construction is achieved, there is no requirement for rotating the first rotator at a rotation speed higher than a conventional one and there is also no concern for increasing the risk of damaging the medicines due to increase of the rotation speed.

DESCRIPTION OF EMBODIMENTS

Hereunder, embodiments of the present invention will be described according to appended drawings. Now, descriptions hereinafter shall essentially be mere examples and shall not intend to limit the present invention, applied objects thereof or use applications thereof.

Figure 1:
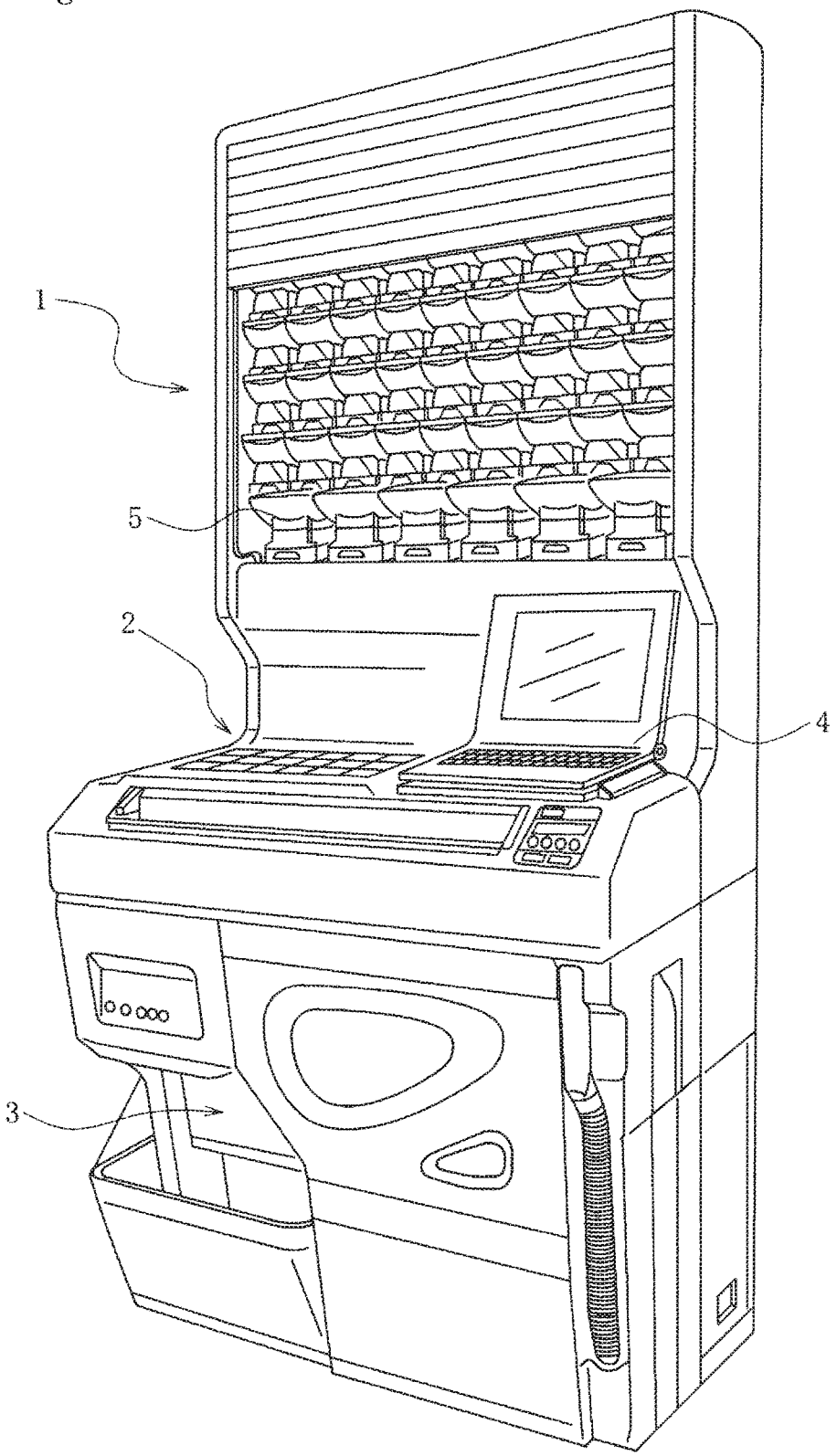
FIG. 1 shows a perspective view of a medicine packaging apparatus of an embodiment of the present invention.

FIG. 1 shows a perspective view of a medicine packaging apparatus of the present invention. The medicine packaging apparatus comprises an automatic medicine supplying unit 1, a hand feed medicine supplying unit 2, a medicine packaging unit 3, and controller unit 4 and the like. In the automatic medicine supplying unit 1, a medicine cassette 5 is set detachably to each of cassette attaching parts (not shown) which are arranged as a matrix form with a plurality of columns along a width direction and a plurality of stages along a height direction.

Figure 2:
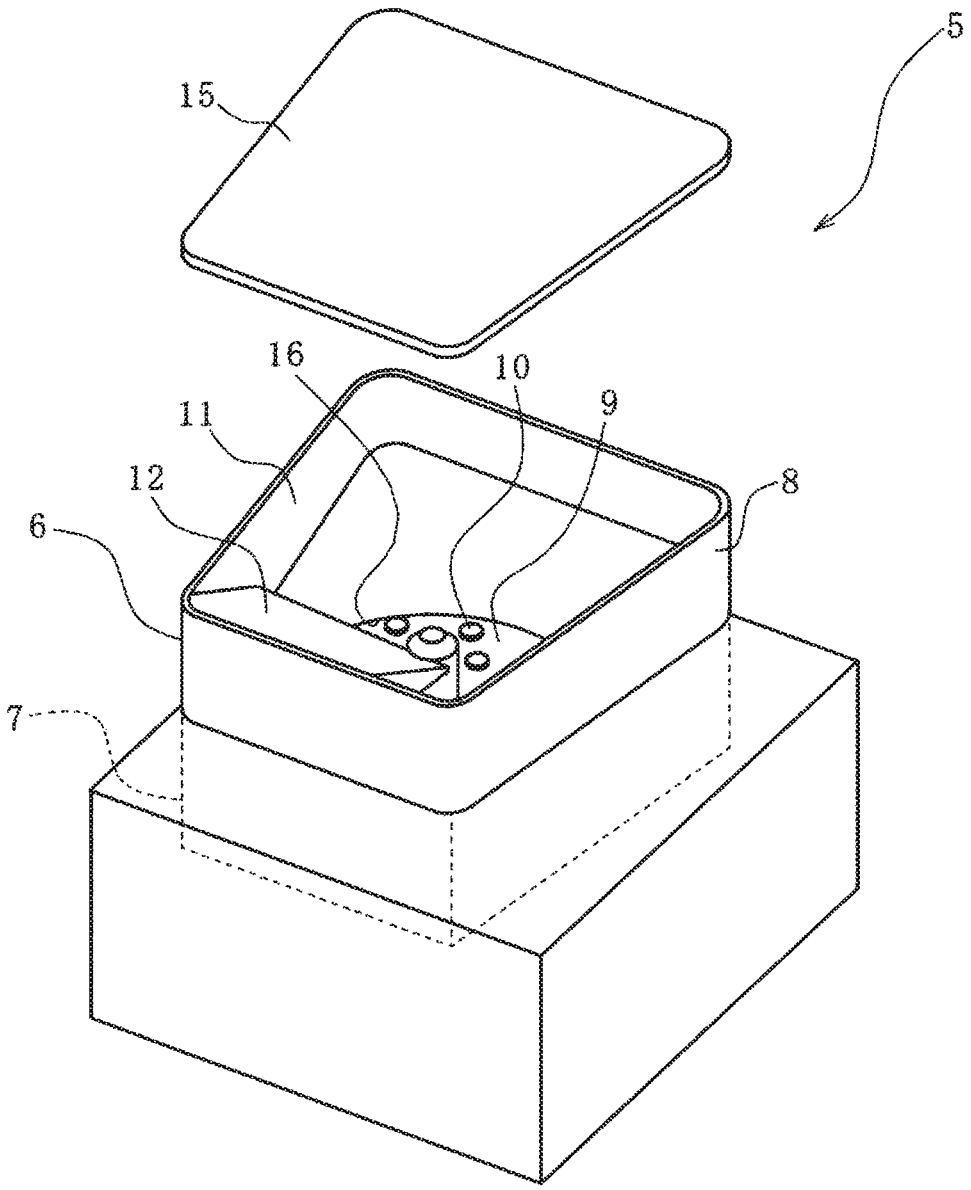
FIG. 2 shows a perspective view of a medicine cassette depicted in FIG. 1.

The medicine cassette 5 comprises, as shown in FIG. 2, a medicine reserving unit 6 and a medicine dispensing unit 7.

The medicine reserving unit 6 is constructed by disposing a supplying rotator 9 in a reserving container 8. In the reserving container 8, a plurality of medicines 10 of the same kind (e.g. tablet or capsule) are retained and are supplied timely to the medicine dispensing unit 7.

Figure 3:
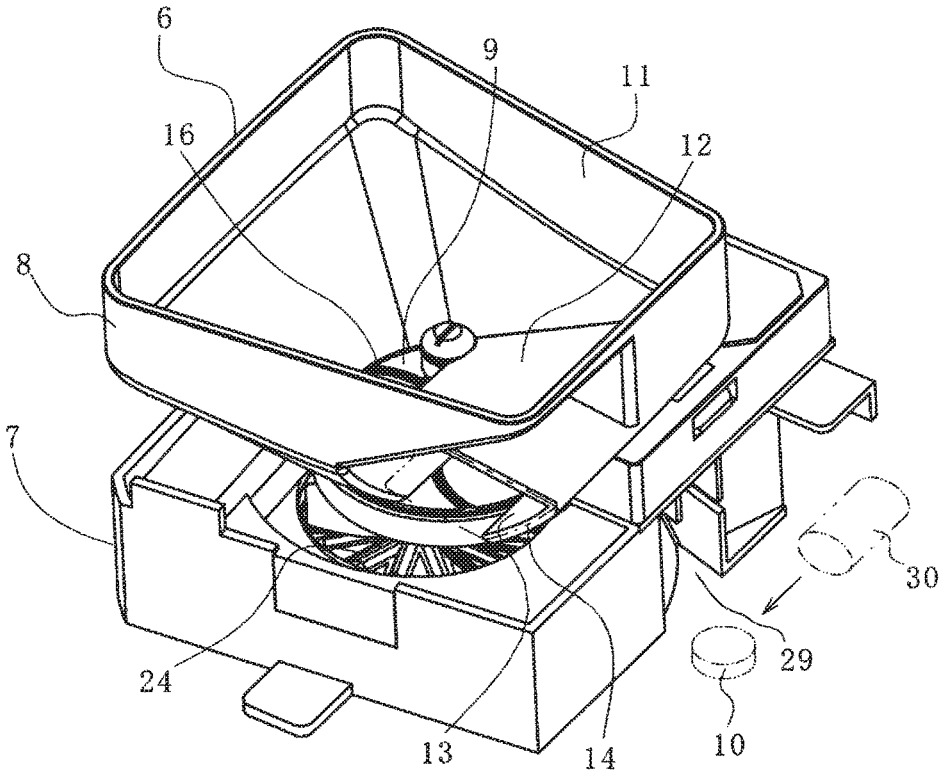
FIG. 3 shows a perspective view of a medicine reserving unit and a medicine dispensing unit depicted in FIG. 2.

The reserving container 8, as shown in FIG. 3, comprises a surrounding wall 11 which has an almost trapezoid shape in a top view. A guide wall 12 extending downwardly and slantingly is formed on one inner face of a side wall which constructs the surrounding wall 11. The medicines 10 may be supplied using this guide wall 12. The guide wall 12 allows the supplied medicines 10 to move smoothly toward a bottom plane side and prevents the medicines 10 from being damaged by impacting the bottom plane side strongly. At a lower side below a region to which the guide wall 12 is formed, a supply port 13 is formed. The supply port 13 may be capable of being opened and closed by a shutter 14 which constructs a shutter member of the present invention.

The shutter 14 may preferably be configured to automatically close when the medicine cassette 5 is detached from the cassette attaching part. For example, the supply port 13 may be closed by the shutter 14 biased by a springs etc. and a contact portion is disposed to the cassette attaching part such that a part of the shutter 14 may contact to the contact portion so as to open the supply port 13.

An upper opening of the reserving container 8, as shown in FIG. 2, is closed by a detachably attached cover body 15. At a center region of a bottom plane of the reserving container 8, an opening 16 is formed to dispose the supplying rotator 9 therein.

Figure 4:
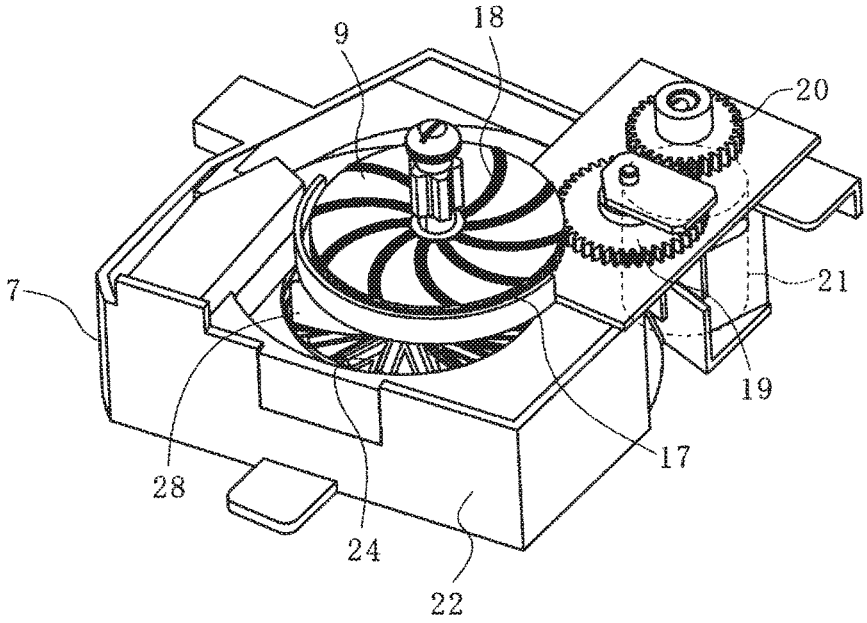
FIG. 4 shows a perspective view of a state in which a reserving container of a medicine reserving unit is removed from FIG. 3.

The supplying rotator 9 has a circular shape and comprises an outer peripheral gear 17 as shown in FIG. 4. A plurality of ridges 18 extend radially outwardly from a rotation center on an upper face.

The outer peripheral gear 17 meshes with a first gear 19 and a second gear 20 sequentially and the second gear 20 is integrated to a rotation axis of a first motor 21. Thereby, driving force of the first motor 21 may be transferred to the supplying rotator 9 through the second gear 20 and the first gear 19. The first motor 21 may be capable of rotating positively and negatively. When the supplying rotator 9 rotates positively, the supplied medicines 10 are transferred to the supply port 13.

Returning to FIG. 4, the ridges 18 extend outwardly and evenly from the rotation axis to a radially outward peripheral side, and in detailed description extend curvedly with gradual displacements toward an upstream side in a rotational direction.

Figure 5:
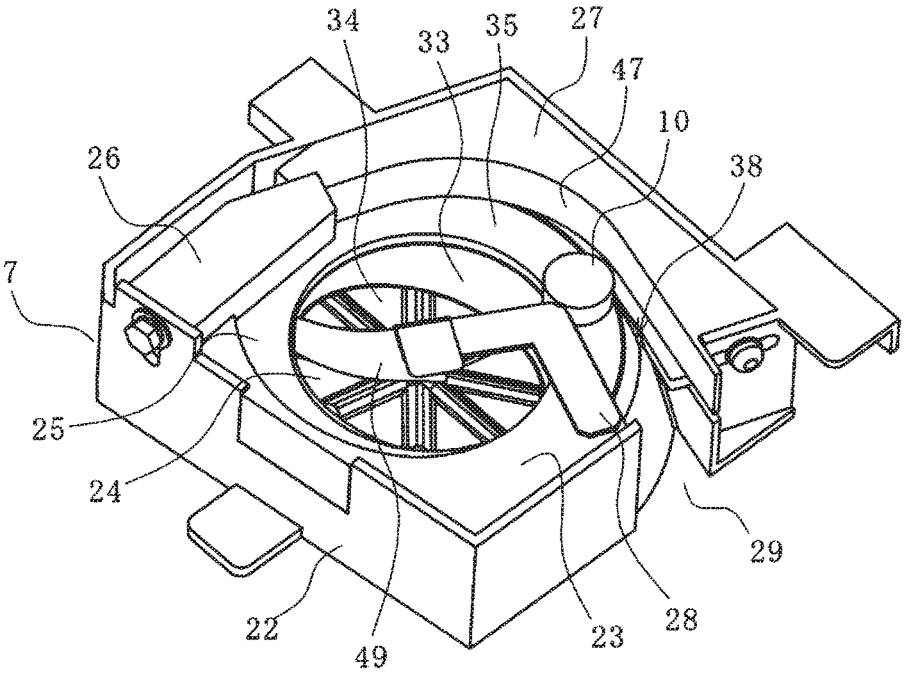
FIG. 5 shows a perspective view of a perspective view of a medicine dispensing unit depicted in FIG. 2.
Figure 6:
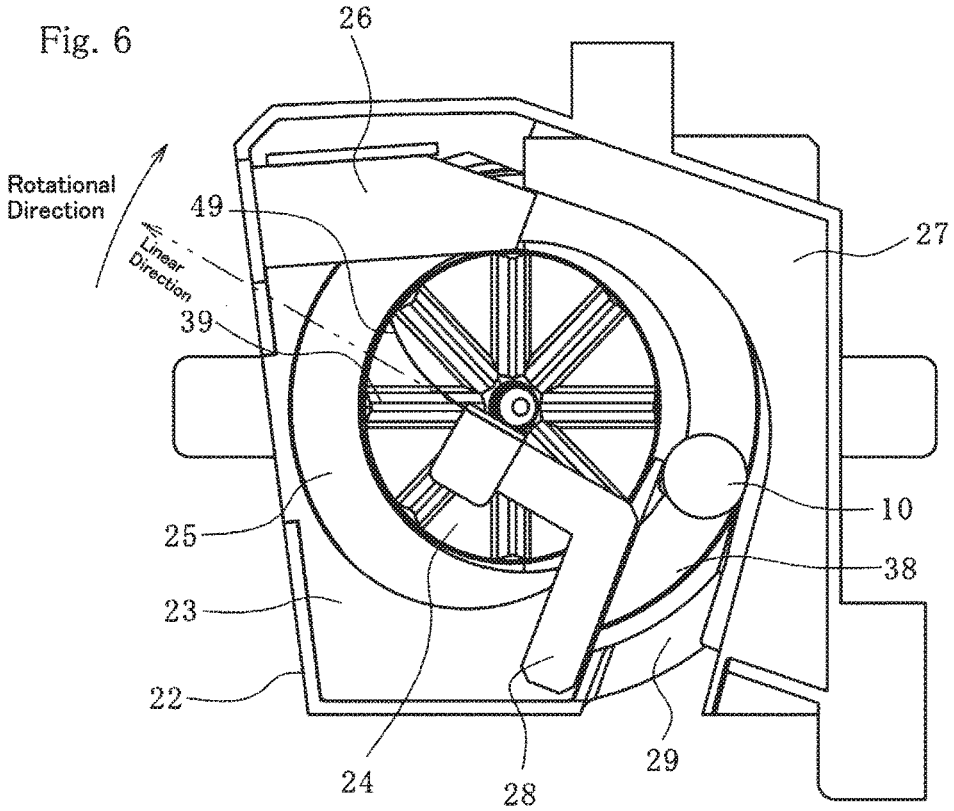
FIG. 6 shows a plane view of FIG. 5.
Figure 7:
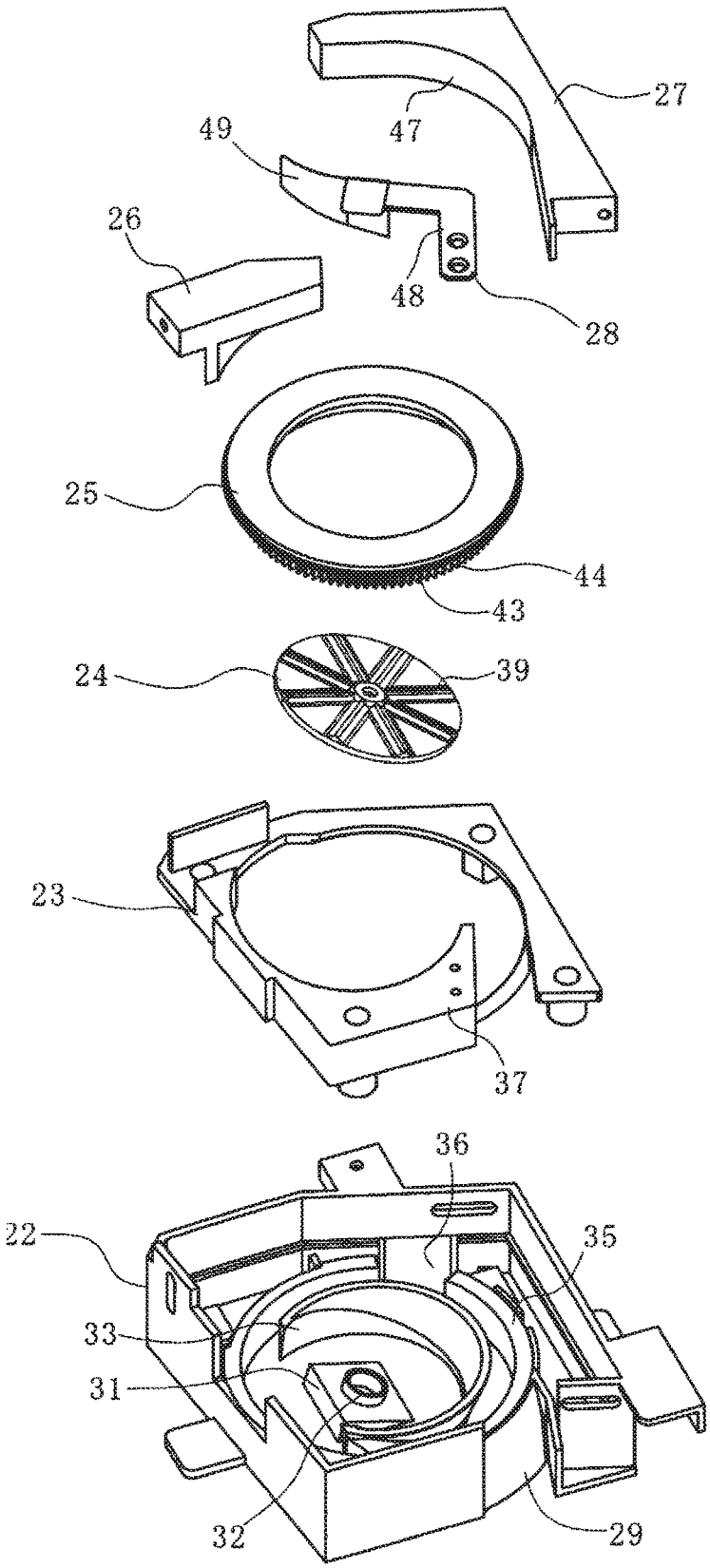
FIG. 7 shows an exploded perspective view of FIG. 5.

The medicine dispensing unit 7, as shown from FIG. 5 to FIG. 7, is the one to which a supporting member 23 is fixed in a supporting container 22 and a first rotator 24, a second rotator 25, a height regulation member 26, a width regulation member 27, and a guide member 28 are attached thereto.

The supporting container 22 is constructed with a surrounding side wall and a bottom wall and each of the supporting member 23, the height regulation member 26 and the width regulation member 27 may be fixed by screwing thereto. By cutting out a part of the side wall, a discharge port 29 for the medicines 10 is formed. The medicines 10 discharged from the discharge port 29, as shown in FIG. 3, may be countably detected by a sensor 30. As shown in FIG. 7, a rectangular protrusion part 31 with a slant top face is formed at the bottom wall and a cylinder part 32 is formed at a center thereof for rotatably supporting the first rotator 24. Around the rectangular protrusion part 31, an arch part 33 protrudes in the condition in which a part of a cylinder shape about a center axis of the cylinder part 32 is cut off. An inner face of the arch part 33 and the slant upper face of the first rotator 24 construct a reserving concave part 34 (see FIG. 5). A ring part 35 is formed around the arch part 33. On the ring part 35, the second rotator 25 is mounted. Driving force of a third motor 45 may be transferred to the second rotator part 25 from a driving gear 46 which is mentioned below through a communication opening 36 formed by cutting off a part of the reserving concave part 34.

The supporting member 23 is disposed in the concave of the supporting container 22 and is fixed by screwing from a lower face side. A part of the supporting member 23 is constructed with a protrusion part 37. An inner face of the protrusion part 37 constructs a part of an inner face surrounding an outer peripheral part of the second rotator 25. The guide member 28 may be fixed by screwing on an upper face of the protrusion part 37. An end face of the protrusion part 37 and the width regulation member 27 disposed oppositely forms a discharge passage 38 (see FIG. 5) therebetween.

The first rotator 24 has a circular plate shape likely to the abovementioned supplying rotator 9 and on an upper face, i.e. a circular face thereof, a plurality of protrusions 39 extend radially from a rotation center (herein, 8 ridges with 45 degrees spacing are formed). The first rotator 24 is disposed such that a rotation axis thereof is slant to a vertical direction and the upper face is slanted to a horizontal plane (a slant angle in the present embodiment is 18 degrees).

Figure 8:
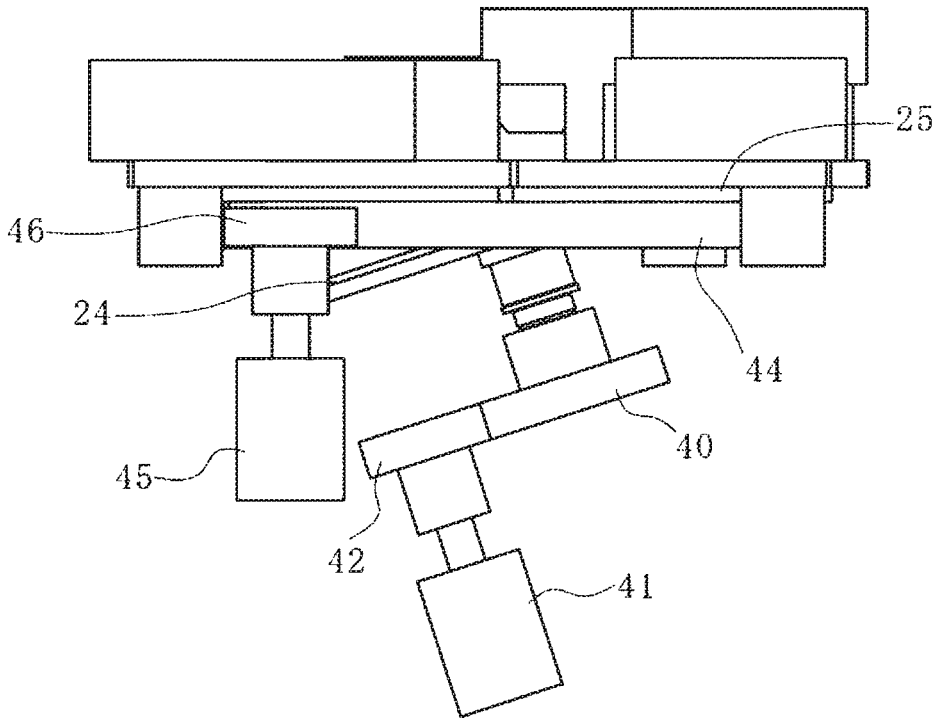
FIG. 8 shows a plane cross sectional view of FIG. 5.

At a lower end of the rotation axis of the first rotator 24, as shown in FIG. 8, a following gear 40 is integrated. A driving gear 42, which is integrated to a rotation axis of the second motor 41, meshes with the following gear 40. Thereby, the driving force of the second motor 41 may be transferred to the first rotator 24 through the driving gear 42 and the following gear 40.

The second rotator 25 is, as shown in FIG. 7, a planar ring plate which is disposed at the outer periphery of the first rotator 24. The second rotator 25 is disposed such that the upper face i.e. the ring face, is disposed so as to be positioned over a horizontal face. Besides, the cylinder part 43 is formed at a lower face side of the second rotator 25 and a following gear 44 is formed at an outer peripheral face thereof. A driving gear 46, as shown in FIG. 8, which is integrated to a rotation axis of the third motor 45, meshes with the following gear 44. Thereby, the driving force of the third motor 45 may be transferred to the second rotator 25 through the driving gear 46 and the following gear 44.

The height regulation member 26 is shaped generally to a rectangular solid and provides a space between a bottom face thereof and the second rotator 25 when fixed by screwing to a side wall of the supporting container 22. The space may be adjusted by changing a screwing position for fixing so as to allow only one medicine 10 to pass through.

The width regulation member 27 comprises a curved surface 47. The width regulation member 27 is fixed by screwing to the side wall of the supporting container 22 and is disposed so as to extend inwardly beyond the outer periphery of the second rotator 25 for regulating an exposed width size of an upper face of the second rotator 25 so that only one medicine 10 may be carried by the second rotator 25. The exposed width size may be adjusted by changing a screwing position for fixing.

The guide member 28 is constructed by a support member 48 and a guide chip 49. The support member 48 is formed to about an "L" letter shape from a planar plate and a through hole for fixing to the support member 23 by screwing is formed at one end side. At an opposite end side of the support member 48, the strip shaped guide chip 49 is fixed at a right angled direction against the upper face of the first rotator 24 in the condition out of contact. For the guide chip 49, a material having flexibility as well as an excellent anti-abrasion property such as a silicone rubber may be used.

As shown in FIG. 6, the guide chip 49 curves gradually to a downstream side of the rotational direction of the first rotator 24 against a radial direction to which the opposite end of the supporting member 48 extends (in FIG. 6, shown by two dotted line). Thereby, the guide face, which swells out to the outer radial side of the first rotator 24, may be formed. When the force larger than that of required is exerted from the contacting medicine 10 due to the rotation of the first rotator 24, the medicine 10 may be moved to an outer radial side by an elastic deformation thereof.

A tip position of the guide chip 49 reaches adjacent to an inner peripheral edge of the second rotator 25 and is located at a shifted position toward the rotational direction from the position where a stepwise difference between the upper face of the first rotator 24 and the upper face of the second rotator 25 becomes almost zero (in FIG. 6, though a pressured contacting state of the medicine 10 to the guide chip 49 is not illustrated, the guide chip 49 will be curved by the pressurized contact of the medicine 10.). Since the tip position of the guide chip 49 is set as described above, the guide chip 49 does not hinder the rotational movement of the second rotator 25 and the medicine 10 can certainly be moved onto the second rotator 25 from the first rotator 24.

In the medicine dispensing unit 7 of the above construction, the tip of the guide chip 49 of the guide member 28 is located at the position where the tip is rotated at about 40 degrees-about 45 degrees from a referenced position at which the stepwise difference between the slant first rotator 24 and the second rotator 25 becomes zero. Besides, the height regulation member 26 is disposed at about 90 degrees rotated position from the referenced position such that the height size of the medicine 10 may be regulated. Furthermore, beyond the height regulation member 26, the width regulation member 27 is positioned at about 180 degrees rotated position from the referenced position.

The controller unit 4 executes motion control for the first motor 21, the second motor 41, and the third motor 45 on the basis of sensor signals of the sensor 30 as well as formulation data from a server (not shown) to carry out the dispensing process as described hereunder.

Next, a motion of the medicine cassette 5 having the above construction will be described. When the medicines 10 retained in the medicine cassette 5 are dispensed, the first rotator 24 and the second rotator 25 are rotated. Thereby, the medicines 10 on the first rotator 24 moves to the circumference direction and will contact with the guide chip 49 of the guide member 28. The medicines 10 contacted with the guide chip 40 move to the outer radial side along the guide chip 49. By providing the guide chip 49, smooth movements become possible even if the rotation speed of the first rotator 24 is slower than that of the conventional one and thus the medicines 10 may not be moved to the outer radial side only by the exerted centrifugal force.

Now, in the case that an outer radial size of the first rotator 24 is reduced significantly comparing with the conventional one and the first rotator 24 is rotated at the similar rotation speed with the conventional one, the centrifugal force exerted to the medicine 10 becomes insufficient. Thus, it becomes necessary to increase the rotation speed of the first rotator 24. However, when the rotation speed of the first rotator 24 becomes high, slipping contact speeds between the medicines 10 and the first rotator 24 become increased and conditions in which the medicines 10 are easy to be damaged are created. According to the present embodiment, by disposing the guide member 28, the rotation speed of the first rotator 24 may be lowered than the conventional one so that the medicines 10 may be transferred onto the second rotator 25 certainly while reducing the damage of the medicines 10 sufficiently. Here, the rotation speed of the first rotator 24 is set to be the same with that of the second rotator 25. That is to say, the speed may be adjusted suitable for dispensing the medicines 10 certainly one by one. Besides, the guide chip 49 is constructed using the material having elasticity. The positions of a height regulation body 26 and a width regulation body 27 are adjustable in response to sizes of the medicines as dispensing objects. In addition, the spacing between the tip of the guide chip 49 (an end of the outer radial direction) and the inner circumference face of the supporting member 23 through which the medicines pass, due to an ability of the elastic deformation of the guide chip 49, changes depending on the sizes of the medicines as dispensing objects. Thus, according to the medicine dispensing unit 7 of the present embodiment medicines having various sizes may be dispensed. The medicines 10 as the dispensing objects have different characters in sizes, forms, and weights. Therefore, if the guide chip 49 is formed with a rigid body, it may be suspicious to blockages of the medicines 10 when the medicines 10 move along the guide chip 49. In this instance, since the guide chip 49 may change the deformation amounts depending on the difference of the characters, particularly in differences of the sizes of the medicines 10, a distance to the inner circumference face formed by the supporting member 23 may be changed to appropriate values. As the result, the guide chip 49 may recover the shape prior to the blockage of the medicines 10 so that the blockage state may be cleared or the blockage may not occur. Furthermore, if plural medicines are set about passing through the space between the tip of the guide chip 49 and the supporting member 23 at the same time, the guide chip 49 may be deformed largely and recover the shape thereof when it bends beyond certain dimensions. As the result, the guide chip 49 may push back a plurality of medicines or depending on cases, the guide chip 49 flicks off the medicines toward the upstream side in the rotational direction of the first rotator 24. Thus, the blockage of the medicines becomes harder between the tip of the guide chip 49 and the inner circumference face of the supporting member 23 and it may be suppressed that a plurality of medicines pass through at the same time between the tip of the guide chip 49 and the inner circumference face of the supporting member 23.

The medicines 10 after moved to the outer radial side are transferred to the second rotator 25 from the first rotator 24. The medicines 10 after transferred to the second rotator 25, according to the rotation of the second rotator 25, first the medicines 10 overlapped more than 2 layers or stood vertically are returned inwardly by the height regulation member 26. The medicines 10 after passed through the height regulation member 26 but oversized beyond a predetermined width size (for example, medicines placed 2 lines side by side, and the like) are returned inwardly by the width regulation member 27.

As described above, the only one medicine 10 after passing regulated allowable regions for passing through by the height regulation member 26 and the width regulation member 27 may be dispensed from the discharge port 29. Here, when the dispensed medicine 10 is detected by the sensor 30, the rotations of the first rotator 24 and the second rotator 25 are terminated. Thereby, one medicine 10 may be dispensed certainly. Then, the rotations of the first rotator 24 and the second rotator 25 will be restarted again. The termination and restart will be repeated each time one medicine 10 is detected by the sensor 30. The dispensing process will be terminated when predetermined numbers of the medicines 10 have been dispensed.

Meanwhile, a sensor (not shown) detects whether the dispensed medicine 10 from the reserving concave part 34 of the medicine dispensing unit 7 is positioned at a particular position or not (for example, on the second rotator 25) and if determination that the medicine is not positioned at the particular position, the rotation of the supplying rotator 9 may be started. Furthermore, by detecting that the medicine is positioned on the particular position, the supplying rotator 9 may be terminated. Alternatively, when amounts of the medicines 10 to be dispensed run up to predetermined given amounts, the determination may be made that the supply of the medicines 10 is necessary and then the supplying rotator 9 may be rotated. The rotation of the supplying rotator 9 may be performed for predetermined time duration on the basis of relations between the time duration determined by experiments and the amounts of the medicines 10 allowed to be supplied. In summary, the medicines may be supplied on the basis of supply conditions of the medicines 10 in the medicine dispensing unit 7 (the former predicts whether the supply condition permits the dispensation or not depending on presence or absence of the medicines 10 at the particular position and the latter calculates the amounts of medicines 10 in the medicine dispensing unit 7 from practically dispensed amounts and specifies the supply condition precisely.).

EXAMPLE

Here, using a conventional medicine cassette 5 (comparative examples 1, 2), a medicine cassette 5 of the above embodiment without the guide member 28 (comparative example 3) and with the guide member 28 (example 1), comparing experiments were conducted. In the comparative experiment 1, the outer diameter size of the first rotator 24 was set to be 160 mm and the slant angle of the first rotator 24 was set to be 13 degrees against the horizontal plane. In the comparative example 2, the outer diameter size of the first rotator 24 was set to be 140 mm and the slant angle of the first rotator 24 was set to be 18 degrees against the horizontal plane. In the comparative example 3 and the example 1, the outer diameter size of the first rotator 24 was set to be 40 mm and the slant angle of the first rotator 24 was set to be 13 degrees against the horizontal plane. Tablets having a diameter of 10 mm were dispensed under the conditions listed in Table 1.

TABLE 1

| | | | Comparative Example 1 | Comparative Example 2 | Comparative Example 3 | Example 1 |
|---|---|---|---|---|---|---|
| second rotator | outer radial size | (nm) | 160.5 | 120 | 40 | 40 |
| second rotator | slant angle | (°) | 18 | 18 | 18 | 18 |
| second rotator | rotational speed | (rpm) | 110 | 157 | 224 | 7 |

As the results of the comparative experiments, as shown in Table 1, the minimal rotation speeds of the first rotator 24 required for dispensing the tablets to the second rotator were to be 110 rpm in the comparative example 1; to be 157 rpm in the comparative example 2; and to be 224 rpm in the comparative example 3, respectively. In contrast to the above, the example 1 could transfer the tablets at 7 rpm.

The rotation speed of the second rotator 25 suitable for dispensing the medicines 10 certainly one by one was to be 7-14 rpm. Therefore, the rotation speed of the first rotator 24 may be set to a similar speed (for example, the identical speed).

As described above, with providing the guide member 28, the medicines 10 were transferred onto the second rotator 25 even though the rotation speed of the first rotator 24 was lowered to the similar level as low as the second rotator 25. Therefore, it was made possible to prevent the medicines 10 from being damaged due to the reduced impact force exerted from the first rotator 24. Besides, the first rotator and the second rotator 25 were terminated each time one medicine 10 was dispensed. Therefore, the medicines 10 may not be erroneously dispensed over the necessities because the movement speeds of the medicines 10 along the circumference direction are increased.

In addition, the present invention shall not be limited to the construction described the above embodiments and there may be various modifications.

Figure 9:
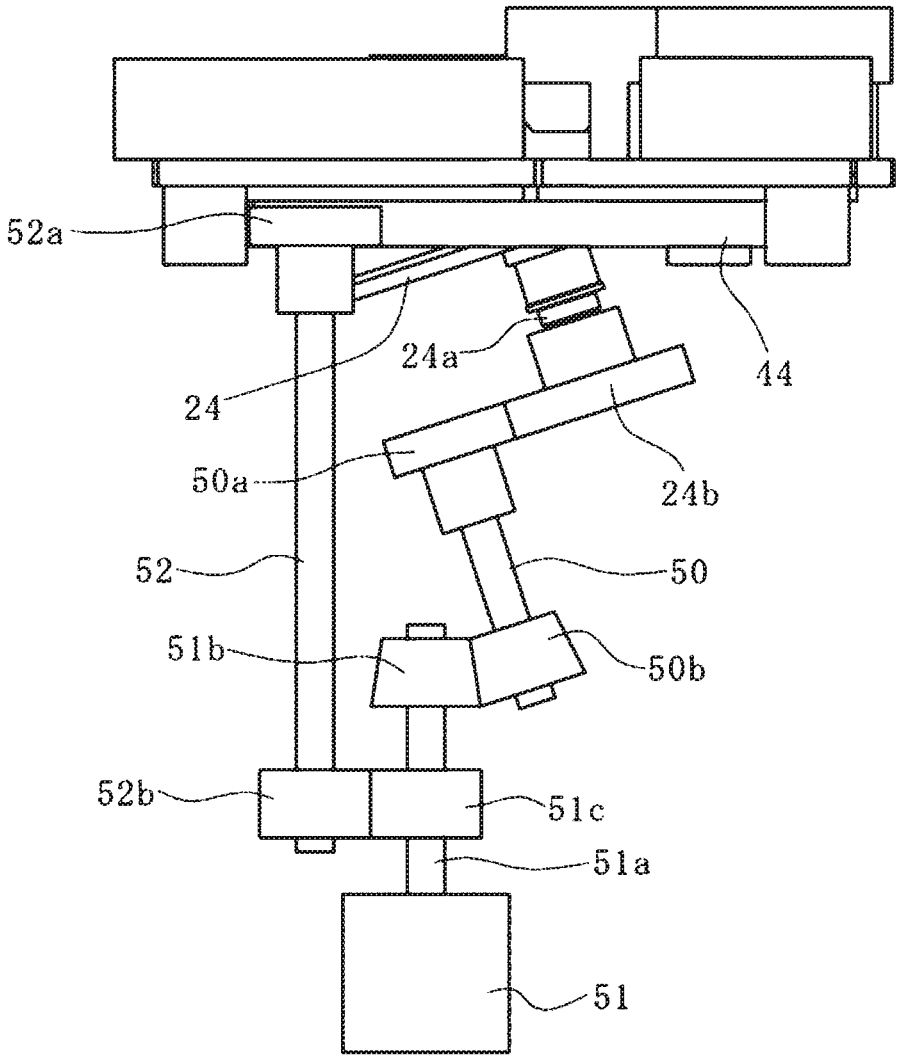
FIG. 9 shows a cross sectional view of an outline of a medicine dispensing unit of another embodiment of the present invention.

For example, in the above embodiments, the first rotator 24 and the second rotator 25 are rotated by separated motors each other, however, it may be possible to rotate using the same motor. For example, as shown in FIG. 9, a spur gear 24*b* may be integrated to the rotation axis 24*b* of the first rotator 24 being slant to the horizontal plane. The spur gear 24*b* meshes with a spur gear 50*a* integrated to a rotation axis 50 at one end side. A bevel gear 50*b* integrated to a rotation axis 50 at the opposite end side meshes with a bevel gear 51*b* integrated to a rotation axis 51*a* of a motor 51. The following gear 44 of the second rotator 25 meshes with a spur gear 52*a* integrated to a rotation axis 52 at one end side. A spur gear 52*b* integrated to the rotation axis 52 at the opposite end side meshes with a spur gear 51*c* integrated to the rotation axis 51*a* of the motor 51. Thereby, when the motor 51 is actuated, the first rotator 24 and the second rotator 25 rotate synchronously through each of the gears.

Alternatively, in the above embodiments, the supply port 13 may be closed when the medicine cassette 5 is detached from the cassette attaching part; however, the medicine dispensing part 7 may be constructed detachably from the medicine cassette 5 and supply port 13 may be closed by the shutter 14 when the medicine dispensing unit 7 is detached therefrom.

REFERENCE SIGNS LIST

1—automatic medicine supplying unit 2—hand feed medicine supplying unit 3—medicine packaging unit 4—controller unit 4 5—medicine cassette 6—medicine reserving unit 7—medicine dispensing unit 8—reserving container 9—supplying rotator 10—medicine 11—surrounding wall 12—guide wall 13—supply port (feed port) 14—shutter 15—cover body 16—opening 17—outer peripheral gear 18—ridges 19—first gear 20—second gear 21—first motor 22—supporting container 23—supporting member 24—first rotator 25—second rotator 26—height regulation member 27—width regulation member 28—guide member 29—discharge port 30—sensor 31—rectangular protrusion 32—cylinder member 33—arch part 34—reserving concave part 35—ring part 36—communication opening 37—protrusion part 38—discharge passage 39—protrusions 40—following gear 41—second motor 42—driving gear 43—cylinder part 44—following gear 45—third motor 46—driving gear 47—curved surface 48—support member 49—guide chip 50—rotation axis 51—motor (driver means) 52—rotation axis

The invention claimed is:

1. A medicine cassette comprising a medicine dispensing unit for dispensing a medicine retained, the medicine dispensing unit comprising:

a first rotator having a circular face rotatably disposed at a slant state to a horizontal plane;

a second rotator having a ring face rotatably disposed over the horizontal plane at an outer peripheral side of the first rotator; and a guide member having a guide face, the guide face being disposed above the circular face of the first rotator while extending radially with respect to the circular face, being positioned at a downstream side in a rotational direction of the first rotator towards a periphery in a radial direction, and being capable of contacting with the medicine placed on the first rotator due to rotation of the first rotator, wherein in the guide member, at least a part including the guide face to be contacted with the medicine is capable of deforming elastically so as to modify a positional relationship to the second rotator depending on a size of the medicine.

2. A medicine cassette comprising a medicine dispensing unit for dispensing a medicine retained, the medicine dispensing unit comprising:

a first rotator having a circular face rotatably disposed at a slant state to a horizontal plane;

a second rotator having a ring face rotatably disposed over the horizontal plane at an outer peripheral side of the first rotator; and a guide member having a guide face, the guide face being disposed above the circular face of the first rotator while extending radially with respect to the circular face, being positioned at a downstream side in a rotational direction of the first rotator towards a periphery in a radial direction, and being capable of contacting with the medicine placed on the first rotator due to rotation of the first rotator, wherein the first rotator and the second rotator stop every time one medicine is dispensed.

* * * * *